US006808250B2

(12) United States Patent
Watanabe

(10) Patent No.: US 6,808,250 B2
(45) **Date of Patent: *Oct. 26, 2004**

(54) PRODUCTION METHOD OF INK-JET HEAD

(75) Inventor: Hideo Watanabe, Hino (JP)

(73) Assignee: Konica Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/999,425

(22) Filed: Dec. 29, 1997

(65) Prior Publication Data

US 2002/0044175 A1 Apr. 18, 2002

(30) Foreign Application Priority Data

Jan. 10, 1997 (JP) ..... 9-002877

(51) Int. Cl.[7] ..... B41J 2/135
(52) U.S. Cl. ..... 347/45
(58) Field of Search ..... 347/45, 47, 68, 347/65; 29/25.35

(56) References Cited

U.S. PATENT DOCUMENTS

| | | | | | |
|---|---|---|---|---|---|
| 4,947,184 | A | * | 8/1990 | Moynihan | 347/47 |
| 5,101,221 | A | * | 3/1992 | Takeuchi | 347/199 |
| 5,163,209 | A | * | 11/1992 | Harada et al. | 29/25.35 |
| 5,376,856 | A | * | 12/1994 | Takeuchi et al. | 310/328 |
| 5,407,136 | A | * | 4/1995 | West et al. | 239/589 |
| 5,426,458 | A | * | 6/1995 | Wenzel et al. | 347/45 |
| 5,428,382 | A | * | 6/1995 | Shimosato et al. | 347/71 |
| 5,458,254 | A | * | 10/1995 | Miyagawa et al. | 216/27 |
| 5,475,407 | A | * | 12/1995 | Ohashi | 347/69 |
| 5,609,629 | A | * | 3/1997 | Fearnot et al. | 623/1 |
| 5,657,063 | A | * | 8/1997 | Takahashi | 347/69 |
| 5,677,717 | A | * | 10/1997 | Ohashi | 347/69 |
| 5,719,606 | A | * | 2/1998 | Kigawa et al. | 347/69 |
| 5,764,247 | A | * | 6/1998 | Asai | 347/10 |
| 5,812,158 | A | * | 9/1998 | Murthy et al. | 347/45 |
| 6,096,070 | A | * | 8/2000 | Ragheb et al. | 623/1 |
| 6,290,340 | B1 | * | 9/2001 | Kitahara et al. | 347/70 |

FOREIGN PATENT DOCUMENTS

| | | |
|---|---|---|
| EP | 0 529 078 A1 | 3/1993 |
| EP | 0 624 473 A2 | 11/1994 |
| EP | 0 647 525 A1 | 4/1995 |
| JP | 5-60844 | 8/1993 |
| JP | 6-143570 | 5/1994 |
| WO | WO 89/07752 | 8/1989 |

* cited by examiner

*Primary Examiner*—Michael Brooke
(74) *Attorney, Agent, or Firm*—Frishauf, Holtz, Goodman & Chick, P.C.

(57) ABSTRACT

A method of producing an ink-jet head having an ink chamber composed of at least a first wall member and a second wall member, wherein the first wall member includes a vibrating wall made of a piezoelectric ceramic on which an electrode layer is formed and the second wall member forms a fixed wall, comprising steps of: (1) combining the first wall member and the second wall member into one body so that the ink chamber is formed between the first wall member and the second wall member and the electrode layer is located inside the ink chamber; and (2) subjecting the combined one body of the first wall member and the second wall member to gas phase polymerization so that a resin layer of poly-para xylylene or its derivative is formed on the electrode layer in the ink chamber.

11 Claims, 4 Drawing Sheets

PRODUCTION METHOD OF INK-JET HEAD

BACKGROUND OF THE INVENTION

The present invention relates to an ink-jet head used for an ink-jet printer and the manufacturing method for the same.

Conventional technology utilizes, the piezoelectric effects of a piezoelectric element as an actuating force for ink-emission by an ink-jet printer. For example, there is described in Japanese Patent Publication No. 4-48622, an ink-jet head system in which an electrode layer is formed inside a fine groove formed on a piezoelectric substrate and further aforesaid electrode layer is covered with an insulating layer for forming an ink path.

The purpose of aforesaid insulating layer is to minimize deformation of the ink and to protect the electrode. It is required that the aforesaid insulating layer be inactive to the ink and the electrode and that it has an affinity to the ink so that feeding of the ink into the flowing path is smooth. As the insulating layer having aforesaid properties, a resin layer composed of a poly-para-xylylene (also referred as a palylene layer) is disclosed in Japanese Utility Publication Open to Public Inspection No. 5-60844 and Japanese Patent Publication Open to Public Inspection (hereinafter, referred as JP) Nos. 6-238897, 6-286150 and 7-246702. Aforesaid resin layer is formed by a CVD (Chemical, Vapor Deposition) method in which a solid di-para-xylylene dimer is used as a deposition source. Namely, a stable di-radical para-xylylene monomer which occurred due to gassification and heat decomposition of di-para-xylylene dimer is adsorbed on a substrate for polymerization reaction and thereby a layer is formed.

When an ink path is processed, ordinarily, after an electrode layer and an insulating layer are formed on a groove on a piezoelectric substrate, the other lid member is adhered thereon. Therefore, in the electrode side member on which a resin layer is applied entirely over the surface including the portion to which the adhesive layer will be applied, deterioration of the adhesive agent and adhesive force reduces the life of the head.

Because the aforesaid resin layer is lipophilic, it is necessary to surface process the resin layer to make it hydrophilic to accommodate the use of water-based ink. In aforesaid technologies, graft polymerization processing, plasma processing, coupling reaction processing, dipping processing using a chromic acid mixture solution and forming of an inorganic mill scale are disclosed. By the use of any of aforesaid conventional processing method of the ink path, the water-based ink emission performance cannot be maintained for a long time employing any of the above-mentioned processing.

SUMMARY OF THE INVENTION

The present invention was devised in view of the above-mentioned situations. An objective is to provide an ink-jet head excellent in terms of water-based ink emission performance for a long time and life thereof.

The above-mentioned objective of the present invention can be attained by a method of manufacturing an ink-jet head in which an ink chamber having at least one vibration wall having an electrode layer on a piezoelectric ceramic substrate is composed of at least two members such as a member having the above-mentioned vibration wall and a member forming a fixed wall. The aforesaid two or more members are adhered together into an integral structure to form a chamber therefore, a resin layer composed of poly-para-xylylene or its derivative is formed on an electrode layer in aforesaid chamber by means of a vapor phase polymerization.

In the above-mentioned manufacturing method, the following are preferable examples:

1. The above-mentioned resin layer is subjected to plasma processing;
2. The above-mentioned electrode layer is composed of aluminum, tantalum or titanium;
3. After the above-mentioned electrode layer is subjected to anodic oxidation processing, a resin layer composed of poly-para-xylylene or its derivative is formed.

The above-mentioned objective is attained by an ink-jet head having at least one vibration wall having an electrode layer on a piezoelectric ceramic substrate, wherein a resin layer composed of poly-para-xylylene or its derivative formed over the complete the surface of inner wall of aforesaid chamber by means of the vapor phase polymerization method.

Namely, the present inventors discovered that life and ink emission performance can be extended by shielding the ink path, including the adhesive agent used to assemble the ink-jet head, from ink with a resin layer formed by means of the CVD method after assembling the members forming the ink path. Further, it was also confirmed that the effects of the present invention can be provided more noticeably if aforesaid resin layer is subjected to plasma processing during the aforesaid forming method.

DETAILED DESCRIPTION OF THE PREFERRED EMBODIMENT

Hereinafter, the present invention will be explained referring to embodiments. However, the embodiments of the present invention are not limited thereto.

Figure 1:
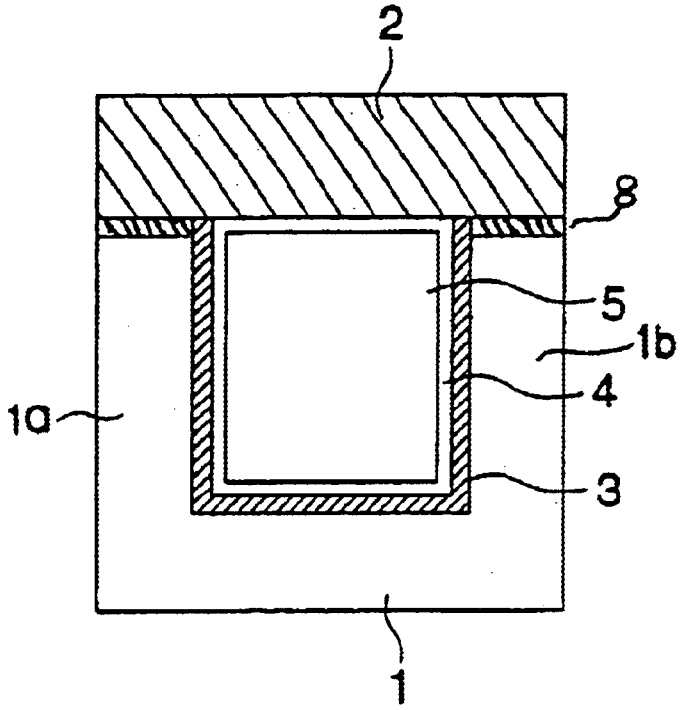
FIG. 1 shows an illustrated cross sectional view of an ink chamber.

FIG. 1 shows an illustrated cross sectional view of an ink chamber of the present invention.

In FIG. 1, numeral 1 represents a piezoelectric ceramic substrate containing vibration walls 1*a*, 1*b*, 2 represents a lid member which forms a fixed wall, 3 represents an electrode layer, 4 represents a resin layer (a perylene layer) and 5 represents an ink chamber.

As a piezoelectric ceramic constituting substrate 1, any of the conventional ones may be used. Those having large filling density such as titanium acid zirconic acid lead are preferable in terms of piezoelectric performance. Lid member 2 is a flat plate joined on substrate 1. A flat plate made of glass, ceramic, metal or plastic can be used.

Figure 2:
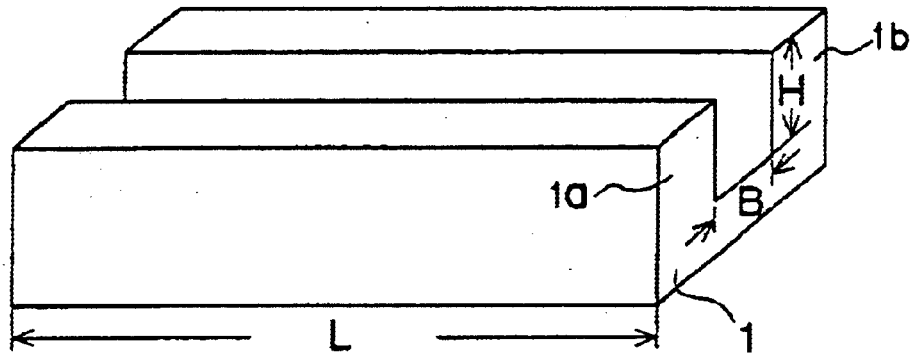
FIG. 2 shows a perspective view of a piezoelectric ceramic substrate.

FIG. 2 shows an example of a substrate 1. A small groove (L: 30 mm, H: 360 $\mu$m and B: 70 $\mu$m) is processed on one side of a 1 mm—thickness substrate 1. By joining lid member 2 on the processed surface of aforesaid substrate 1, an ink chamber (L: 30 mm, H: 360 μm and B: 70 μm), an ink path, is constituted on the groove portion. One end of the ink chamber is connected with the ink feeding section, and the other end of ink chamber is connected to ink emission section.

As a preferable example of the present invention, the ink chamber of the present invention is formed by means of the following procedures:

1. Electrode layer forming step
2. Adhesion step
3. Resin layer forming step
4. Plasma processing step 1. Electrode Layer Forming Step In order to form electrode layer 3 on a small groove portion processed on substrate 1 with a thin layer (ordinarily, 0.5–5.0 μm), electrode layer 3 is formed by means of sputtering. It is preferable that electrode layer 3 is made of aluminum, tantalum or titanium from the viewpoint of electrical properties, anti-corrosion property and processability. In order to improve anti-corrosion property and stability of electrode layer 3, it is effective to provide anodic oxidation processing, for example as described below. Next, practical example of the anodic oxidation processing will be exhibited.

As an electrolytic solution, a mixture composed of 300 ml of ethylene alcohol and 30 ml of 3% tartaric acid whose pH was 7.0±0.5 (regulated with an aqueous ammonia) was used. A piezoelectric ceramic substrate on which 2 μm aluminum electrode layer was formed was immersed in aforesaid solution. In the solution, the electrode layer side was set to be positive, and was subjected to anodic oxidation in which the electrical current density was 1 $MA/cm^2$ and the current was constant-current until the voltage reaches 100 V and the voltage was constant-voltage of 100V after the voltage reached 100V. When the electrical current density becomes 0.1 $mA/cm^2$ or less, the processing is finished.

2. Adhesion Step

In the present invention, after the above-mentioned electrode layer is subjected to anodic oxidation, prior to the resin layer forming step, a step for adhering substrate 1 and lid member 2 is included.

In the adhesion step, before coating an adhesive agent, a processed surface on which a groove on substrate 1 and a joint surface for lid member 2 which covers the above-mentioned groove are subjected to cleaning and polishing depending upon their conditions. Following this, adhesive surfaces are respectively formed.

An adhesive surface on substrate 1 and an adhesive surface on lid member 2 are adhered with an epoxy-containing adhesive agent so that substrate 1 and lid member 2 become integral. After assembly, the adhesive surface is heated up to about 120° C. while being pressed. Aforesaid heating and pressing conditions are maintained for about 2 hours so that the adhesive agent is hardened. Due to aforesaid adhesive step, an adhesive agent layer, whose thickness is 1.0–2.0 μm is formed between each adhesive layer. In addition, between integral substrate 1 and lid member 2, an ink chamber, which forms an ink path, is constituted.

3. Resin Layer Forming Step

After the adhesive step, integral substrate 1 and lid member 2 are subjected to chemical deposition which forms resin layer 4.

Figure 3:
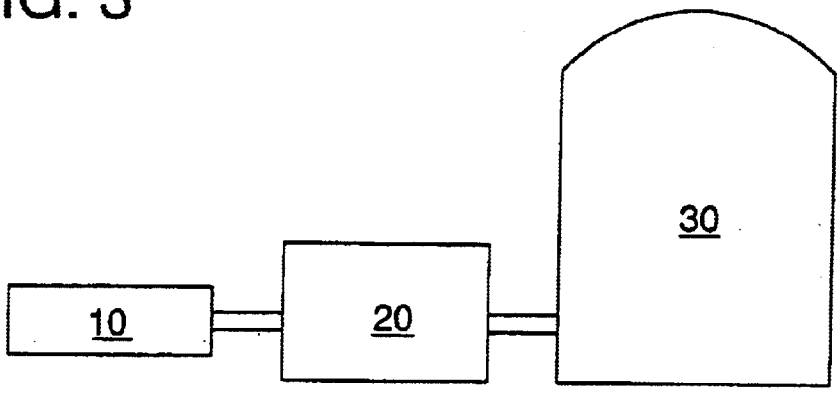
FIG. 3 shows a block diagram of a deposition device which conducts chemical deposition of the present invention.

FIG. 3 shows an example of a deposition device which conducts chemical deposition which forms resin layer 4 composed of poly-para-xylylene of the present invention or its derivative. The deposition device in FIG. 3 is composed of sublimation furnace 10, heat decomposition furnace 20 and casting tank 30. The above-mentioned sublimation furnace 10, heat decomposition furnace 20 and casting tank 30 are connected by piping, as shown in FIG. 3, which forms a gas path. During deposition, the degree of vacuum of the above-mentioned deposition device is kept at $10^{-3}$ to 1.0 Torr. Inside sublimation furnace 10 is kept at 100–200° C., inside heat decomposition furnace 20 is kept at 450–700° C. and inside casting tank 30 is kept at room temperature.

Inside sublimation furnace 10, solid dimmer di-para-xylylene, which is a raw material of resin layer 4, is subjected to gasification. In heat decomposition furnace 20, heat decomposition in which gasificated dimer (structural formula A) is subjected to heat decomposition for generating para-xylylene radical (structural formula B) is conducted. In casting tank 30, a rotation stand which rotates at around 10 rpm is provided. On aforesaid rotation stand, integral substrate 1 and lid member 2 are located. Para-xylylene radical which occurred in heat decomposition furnace 20 adheres on substrate 1 and lid member 2 located on the rotation stand in casting tank 30. In aforesaid casting tank 30, together with adhering substrate 1 and lid member 2, para-xylylene radical was subjected to vapor phase polymerization for forming a resin layer of poly-para-xylylene (structural formula C) having high molecular weight. Here, examples a resin layer composed of a poly-para-xylylene derivative will be exhibited in structural formula D.

Structural formula A

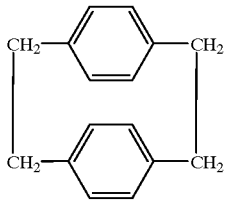

Structural formula B

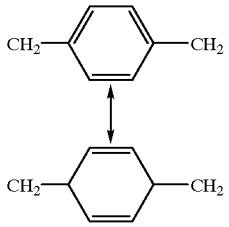

Structural formula C

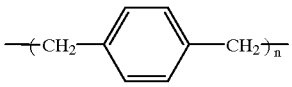

Poly-p-xylylene
(ParyleneN)

Structural formula D

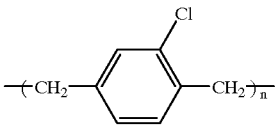

Poly-mono-chloro
-p-xylylene
(ParyleneC)

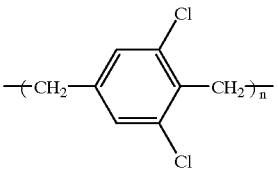

Poly-di-chloro
-p-xylylene
(ParyleneD)

-continued

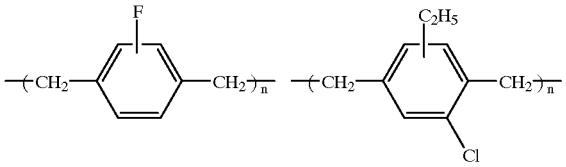

Thickness of resin layer formed is preferably 1.0–10 μm from the viewpoint of covering and protecting the electrode layer for retaining insulation property. If it is too thick, movement of moving portion of the ink chamber is restricted.

Example of Forming Resin Layer

In the deposition device in FIG. 3, 50 g of di-para-xylylene (the raw material) was subjected to gasification in sublimation furnace 10 at 190° C. The gasificated di-para-xylylene was subjected to heat decomposition in heat decomposition furnace 20 at 680° C. for generating para-xylylene radical. The generated para-xylylene was introduced into casting tank 30 in which the pressure was evacuated to 0.1 Torr. In aforesaid casting tank 30, a resin layer was formed on integral substrate 1 and lid member 2 for 4 hours. Due to this, on the inner wall inside the ink chamber, a resin layer having 3 μm thickness could be formed.

4. Plasma Processing Step

When an ink chamber is constituted by means of the present invention, it is advantageous that the resin layer formed in the above-mentioned step is subjected to plasma processing. As the plasma processing, the following processing is cited as a practical example.

| (Processing conditions) |
|---|
| Device: Parallel and flat type reacting vessel |
| Raw material gas: oxygen |
| Flow rate of gas: 50 sccm |
| Pressure: 10 Pa |
| Discharging method: High frequency (13.56 MHz, 200W) |
| Processing time: 2 minutes |

According to aforesaid processing, the resin layer is subjected to etching of 0.5 μm, and thereby the surface is activated. As a result, the contact angle of water of 85° before processing becomes 10°, after processing. Thus, wettability is improved. An example of another effective plasma processing is a method employing a micro-wave is cited. Gas to be used is not limited to oxygen. Nitrogen and other gasses and a mixed gas between oxygen and inactive gas are cited.

Comparative Test

In order to conduct a comparative test with an ink jet head of the present invention having an ink chamber formed as described above, a comparative ink jet head was prepared under the following procedure.

Substrate 1 in which electrode layer was formed on a groove was subjected to a resin layer forming step without integralizing with lid member 2. Due to this, a resin layer was also formed on the adhesive surface of substrate 1, too. Following this, the adhesive surface of substrate 1 in which the resin layer was formed and the adhesive surface of lid member 2 were adhered for preparing a comparative ink jet head.

As a comparative test, a continuous emitting test was conducted. The ink jet head of the present invention could emit at impressing voltage of 20 V. However, in the case of a comparative ink jet head, it was necessary to increase the impressing voltage to 40 V. In addition, the comparative ink jet head became impossible to emit after 20 hours. However, the ink jet head of the present invention could stably emit for 100 hours or more.

Figure 4:
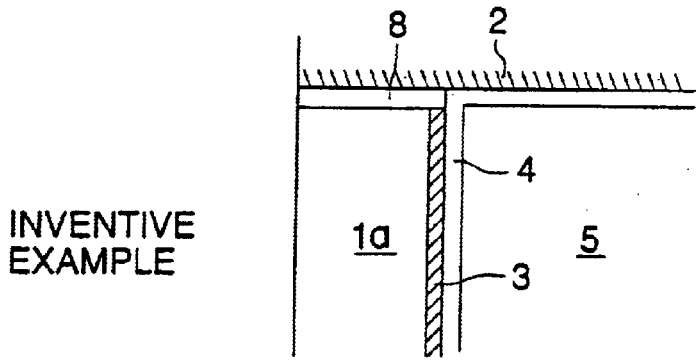
FIGS. 4(*a*) and 4(*b*) are cross sectional views showing an adhesive portion between a piezoelectric ceramic substrate and a lid member.
Figure 4:
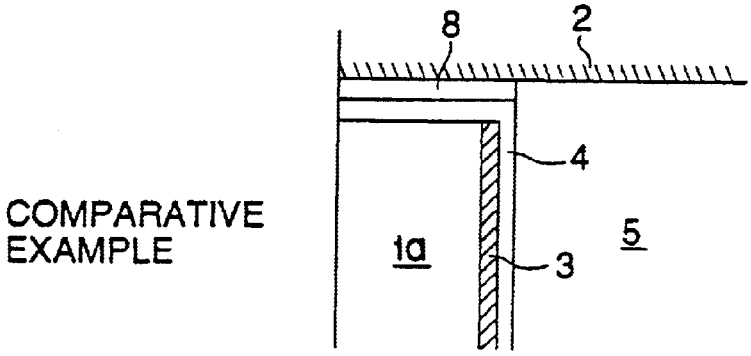
Figure 5:
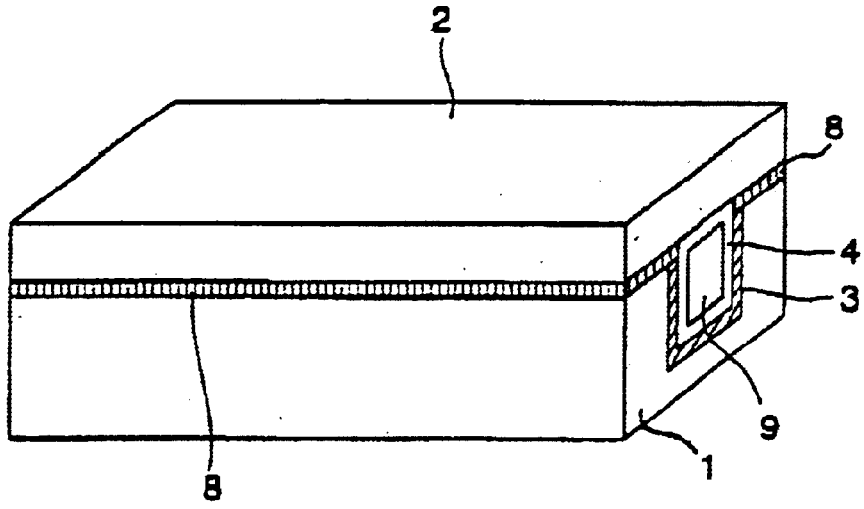
FIG. 5 is a perspective view showing an ink-jet head of the present invention.

FIGS. 4(*a*) and 4(*b*) are illustrative cross sectional view showing adhesive portions between substrate 1 and lid member 2. As described in FIG. 4(*a*), in the ink jet head of the present invention, a resin layer forming step is conducted after integralizing substrate 1 and lid member 2 by means of the adhesive step. Therefore, the adhesive surface of substrate 1 and that of lid member 2 are fixed only with adhesive agent 8. On the contrary, in the case of the comparative ink jet head, the adhesive step is conducted after substrate 1 is subjected to the resin layer forming step. Therefore, adhesive agent layer 8 fixes the adhesive surface of substrate 1 and the adhesive surface of lid member 2 through resin layer 4. Accordingly, it is assumed that, in the case of the comparative ink jet head, adhesive force between substrate 1 having a vibration walls 1*a*, 1*b* and lid member 2 forming a fixing wall is insufficient.

The present invention has the following effects:

As described above, a small ink chamber (L: 30 mm, H: 360 μm and B: 70 μm) is provided between integral substrate, 1 and lid member 2. In aforesaid ink chamber, apertures 9 are only provided on the ink feeding portion side and ink emission portion side. In addition, aforesaid apertures 9 are so small as to be (H: 360 μm×70 μm) In spite of this, due to the resin layer forming step of the present invention, para-xylylene radical which occurred due to heat decomposition invades from aforesaid small apertures 9 and adheres on an ink chamber having depth of 30 mm. Simultaneously with this, due to vapor phase polymerization, the poly-para-xylylene resin layer having high molecular weight can be formed in the small ink chamber.

According to a conventional deposition method, a layer can be formed only on an exposed surface. Therefore, when a layer is formed on electrode layer 3 formed on a groove of substrate 1, it was necessary to conduct deposition while the groove of substrate was exposed prior to an adhesive step with lid member 2.

On the contrary, in the case of chemical deposition in which a resin layer, composed of poly-para-xylylene or its derivatives, is formed, even after substrate 1 and lid member 2 are secured together in the adhesive step, a resin layer can be formed on the inner wall inside the ink chamber through extremely small apertures 9.

According to an experiment by the present inventors, it was confirmed that a layer could be formed in the inner wall of chamber in which the depth was 2–50 mm, through an aperture 9, on both end of the chamber of 1–1000 $\mu m^2$.

As described, prior to the resin layer forming step, substrate 1 and lid member 2 can be integralized in the adhesive step. The adhesive surface of substrate 1 and the adhesive surface of lid member 2 can be fixed with a sufficient adhesive force so that ink can be emitted with a relatively low impressing voltage.

According to the present invention, a chamber is formed by integralizing a piezoelectric ceramic substrate having a vibration wall having an electrode layer and a lid member forming a fixed wall. Following this, by means of a vapor phase polymerization method, a resin layer composed of poly-para-xylylene or its derivative is formed for forming an ink path. Thus, an ink jet head excellent in terms of emission performance of water-based ink for a long period and a life.

What is claimed is:

1. A method of producing an ink-jet head for water base ink, the ink-jet head comprising at least a first member, a second member and an ink chamber therebetween, wherein the first member includes two vibrating wall portions and a base portion, each vibrating wall portion having a piezoelectric ceramic and an electrode layer, the two vibrating wall portions being located on the base portion so that each said electrode layer faces said ink chamber; said method comprising sequentially performing steps of:

(1) combining the first member with the second member by an adhesive so that said ink chamber is formed between the first member and the second member in the combined first and second members, whereby an adhesive layer is formed between the second member and each of the two vibrating wall portions; thereafter (2) forming a resin layer of poly-para xylylene or a derivative thereof selected from the group consisting of mono-chloro, di-chloro, fluoro and ethyl derivatives, on an entire inner surface of the ink chamber including the base portion, the two vibrating wall portions, each of said electrode layers, the second member and a surface of the adhesive layer faced in the ink chamber, by chemical vapor deposition method after the step of combining; and thereafter (3) conducting a plasma processing to the combined first and second members so that an entire surface of the resin layer formed on the entire inner surface of the ink chamber formed between the first member and the second member is made to be wettable to the water base ink.

2. The method of claim 1, wherein the ink chamber has an aperture at an end of the ink chamber, the aperture being formed by the first member and the second member, and the resin layer is formed by introducing poly-para xylylene or said derivative into the ink chamber through the aperture.

3. The method of claim 2, wherein an area of the aperture is 1 $\mu m^2$ to 1000 $\mu m^2$ and a length of the ink chamber is 2 mm to 50 mm.

4. The method of claim 1, wherein a thickness of the resin layer is 1.0 $\mu$m to 10 $\mu$m.

5. The method of claim 1, wherein a thickness of the adhesive layer is 1.0 $\mu$m to 2.0 $\mu$m.

6. The method of claim 1, wherein the electrode layer is made of aluminum, tantalum or titanium.

7. The method of claim 1, further comprising performing an anodic oxidation processing on the electrode layer before forming the resin layer.

8. The method of claim 1, wherein in step (1), the inner surface of said ink chamber is formed by the surface of the two vibrating wall portions, the surface of the base portion, the surface of the second member and the surface of the adhesive layers, each of which face said ink chamber, and in step (2), said resin layer is formed on the entire inner surface of said ink chamber.

9. The method of claim 1, wherein the plasma processing is performed so as to etch the entire surface of the resin layer.

10. The method of claim 1, wherein the plasma processing is performed in the presence of oxygen gas.

11. The method of claim 10, wherein the plasma processing is performed with a high frequency wave discharging.

* * * * *